US005653399A

United States Patent [19]

Koutonen et al.

[11] Patent Number: 5,653,399

[45] Date of Patent: Aug. 5, 1997

[54] METHOD AND ASSEMBLY FOR CUTTING A WEB

[75] Inventors: Pauli Koutonen, Jokela; Jarmo Malmi; Heikki Niskanen, both of Järvenpää, all of Finland

[73] Assignee: Valmet Corporation, Helsinki, Finland

[21] Appl. No.: 567,962

[22] Filed: Dec. 6, 1995

[30] Foreign Application Priority Data

Dec. 13, 1994 [FI] Finland ..... 945862

[51] Int. Cl.[6] ..... B65H 19/26

[52] U.S. Cl. ..... 242/527.3

[58] Field of Search ..... 242/527, 527.2, 242/527.3

[56] References Cited

U.S. PATENT DOCUMENTS

| | | | |
|---|---|---|---|
| 4,157,794 | 6/1979 | Brandauer et al. | 242/527.3 |
| 4,368,855 | 1/1983 | Schönmeier et al. . | |
| 4,444,360 | 4/1984 | Kaipf et al. . | |
| 4,515,321 | 5/1985 | Kahlman | 242/527.3 |
| 4,516,735 | 5/1985 | Snygg | 242/527.3 |
| 4,601,441 | 7/1986 | Oinonen et al. | 242/527.3 |
| 4,609,162 | 9/1986 | Kataoka | 242/527.3 |
| 4,789,109 | 12/1988 | Kyytsonen et al. | 242/527 |
| 4,988,052 | 1/1991 | Urban . | |
| 5,012,987 | 5/1991 | Dropczynski | 242/527.2 |
| 5,273,226 | 12/1993 | Dropczynski . | |
| 5,310,130 | 5/1994 | Wieland et al. . | |
| 5,478,026 | 12/1995 | Schönmeier et al. | 242/527.2 |

FOREIGN PATENT DOCUMENTS

| | | | |
|---|---|---|---|
| 0460395B1 | 12/1991 | European Pat. Off. . | |
| 60-232358 | 11/1985 | Japan | 242/527 |
| 341100 | 10/1959 | Switzerland | 242/527.3 |

*Primary Examiner*—John P. Darling
*Attorney, Agent, or Firm*—Cohen, Pontani, Lieberman, Pavane

[57] ABSTRACT

A method and apparatus for cutting a paper or paperboard web particularly in a winder comprising at least one support roll (2) on which a roll (1) being wound is rotated. A curved, tensioned cutting blade (6) is rotated about the support roll (2) into the nip between the support roll (2) and the roll (1), whereby the sharpened and optionally toothed edge (9) of the blade cuts the web (4) being wound onto the roll (1) at a desired point.

52 Claims, 3 Drawing Sheets

METHOD AND ASSEMBLY FOR CUTTING A WEB

FIELD OF THE INVENTION

The present invention relates to a method and apparatus for cutting a paper or paperboard web particularly on a winder comprising at least one support roll on which a roll being wound is rotatably supported.

BACKGROUND OF THE INVENTION

In conjunction with paper and board manufacture, the webs must be reeled into mill rolls, which are unwound and rewound back into rolls. Equipment employed for reeling up the web into a roll at the end of the papermaking line is called a winder. Conventionally, the winder is located at the end of the papermaking line. If web finishing is performed on the paper machine, the number of required winders is only one, while off-machine finishing of the web in a separate finishing station requires a winder at the ends of both the papermaking line and the finishing line. A winder is also required at slitter stations. The winder typically has one or two support rolls on which the roll to be wound is supportedly rotated. Furthermore, the equipment comprises arrangements for leading the web onto the support roll and devices for removing a full roll and placing a core for the new roll onto the support roll.

In winders having two support rolls, the web is cut after the roll is finished by means of a knife located between the support rolls by actuating the knife to cut the web prior to the nip between the support roll and the roll. The knife may have a length extending over the entire cross-machine width of the web, or alternatively, a short knife can be used that is moved cross-directionally across the width of the web. While a long knife extending over the entire width of the web is difficult to move between the support rolls due to the limited space available, the crosswise moved short knife has disadvantages in that it is slow and results in cutting the web obliquely unless the winder is stopped for the duration of the web cutting operation. In equipment having only one support roll, this cutting method is not applicable, because the tail of the cut web cannot be reliably led into the nip between the support roll and the roll core. Hence for equipment with a single support roll, the web is cut on the surface of the finished roll, whereby the web tail becomes long and must be further shortened. Furthermore, the topmost plies of the finished roll may easily become damaged during the cutting of the web.

To avoid the shortcomings of the above-described cutting methods, a cord cutting device has been developed based on cutting the web by virtue of taking a cord into the nip between the support roll and the paper roll, whereby the cord cuts and severs the web. The cord is arranged to move into the nip between the support roll and the paper roll so that the cord will be trapped between the topmost ply of the roll and next ply underneath, whereby the topmost ply of the roll remains between the support roll and the cutting cord. After the cord has passed the nip and is moved away from the nip on the other side of the nip, the cord tensions the topmost ply of the roll thus cutting it off. After the web is cut, the full roll is removed from above the support roll and a new roll core is brought in the gap between the support rolls. After the web is cut, the rotation of the support roll is braked to full stop and a new core is brought for the new roll. Prior to cutting the web, glue can be sprayed onto that web surface which will face the next to last ply of the roll in order to secure one end of the web to the roll and the other to the core, respectively.

Some of the most serious problems of the cord cutting device are the ill-defined cutting result and torn cut edge. When the cord is taken through the nip, it remains curved, whereby the cord cuts the edges of the web first. Moreover, the cutting point cannot be controlled accurately, because the cutting action is based on severing the web through tightening the cord, whereby the cutting point varies depending on web qualities and web tension. As the web is cut by pulling a relatively thick cord or equivalent noncutting member across the web, the cutting occurs not by neat cutting, but rather, by tearing. For the same reason, the cutting line must be curved, because the web is easiest torn along a line starting from the web edge. Furthermore, it is obvious that this cutting method is ill suited for heavier grades of paper and paperboard.

SUMMARY OF THE INVENTION

It is an object of the present invention to achieve a method capable of cutting a web at a reel or winder neatly and without causing damage to the paper roll.

The object of the present invention is achieved by using a curved, tensioned blade between the support roll and the paper roll, whereby the sharpened and optionally toothed edge of the blade cuts the web at a defined point.

The blade is positioned adjacent the surface of the support roll and is rotationally mounted to the axis of the support roll. When the blade is rotated about the support roll past the nip between the support roll and the paper roll, the blade cuts the web along its entire width in a straight clean cut. The end of the web is then pressed by the blade against the support roll.

The invention offers significant benefits.

The most important advantage of the present invention is that it provides positive and reliable cutting of the web independently from paper grade and qualities. The end of the cut web remains stable on the support roll, and the cutting point is always in the same position relative to the support roll. This helps securing the web end onto a new core and starting the winding of a new roll. With the help of the blade, also thick paper grades and paperboard can be cut readily without the risk of tearing the web, and obviously, the straight edge of the blade renders a straight cut. As the blade is sideways curved, it conforms well to the circumferential shape of the support roll, and pulled by the roll, easily enters the nip without causing damage to a full roll. The blade makes cutting action fast, because the blade can be taken into the nip at the full rotational speed of the support roll and it can be withdrawn extremely rapidly.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the drawings, wherein like reference numerals delineate similar elements throughout the several views.

DETAILED DESCRIPTION OF THE PRESENTLY PREFERRED EMBODIMENTS

Figure 1:
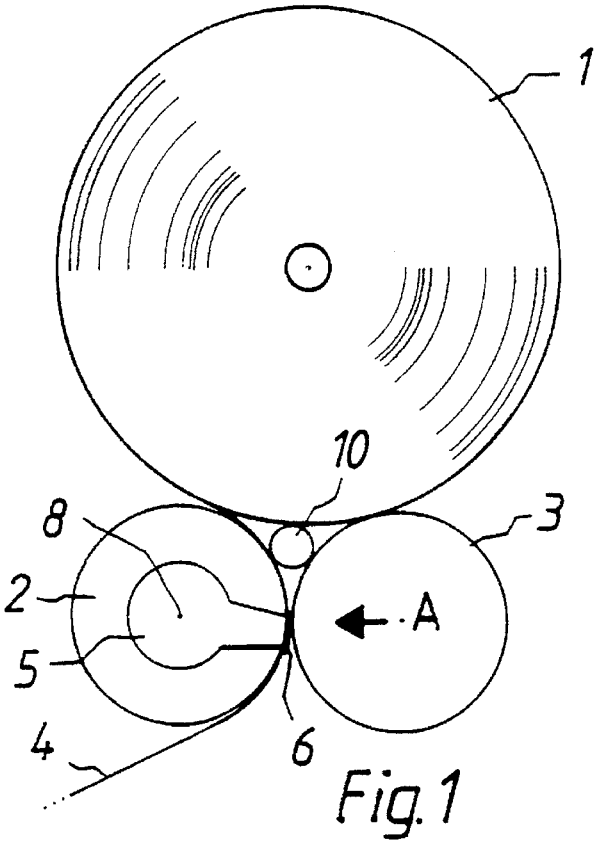
FIG. 1 is a diagrammatic side view of an embodiment according to the invention.
Figure 2:
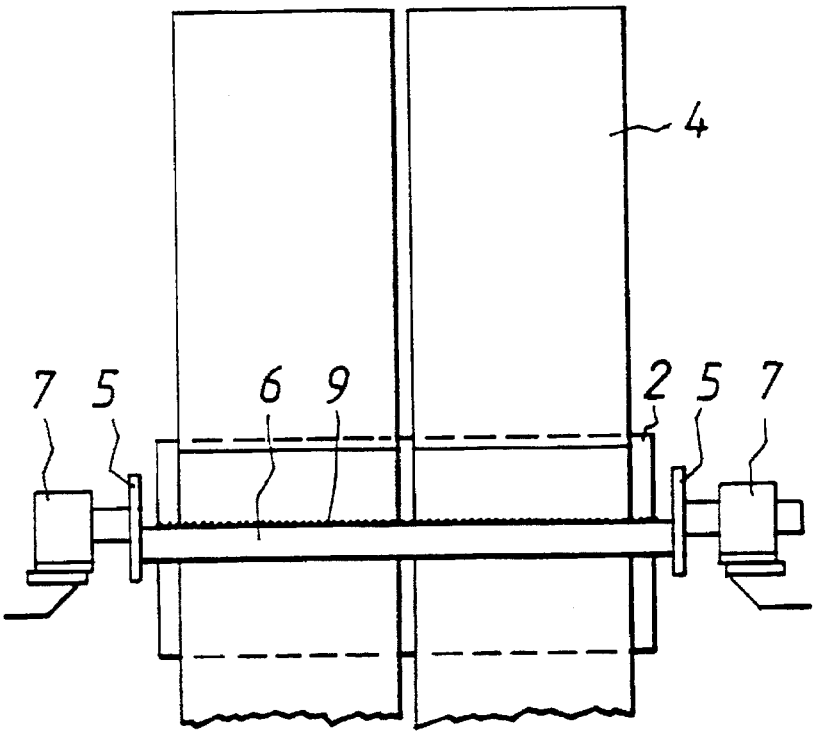
FIG. 2 is a diagram illustrating the function of the assembly according to the invention as seen from direction A marked in FIG. 1.

As is evident from the diagrams, the assembly has an extremely simple construction. Referring to FIG. 1, a two-roll winder is shown therein with the cutting assembly according to the present invention adapted thereto. In the illustrated winder, the winding roll 1 is wound resting on two parallel, adjacent support rolls 2, 3. The web 4 being wound is passed onto the roll 1 from below the support rolls 2, 3 via the gap between the support rolls, and, in the embodiment shown in FIG. 1, is then passed over the left-side support roll 2 to wind onto the roll 1. A web cutting assembly is adapted in conjunction with the left-side support roll 2. The cutting assembly comprises a cutting blade rotating device 7 mounted to both ends of the support roll 2, as shown in FIG. 2 whereby a blade holder 5 is connected to the rotating device 7 on the side facing proximate the end of the support roll 2. The blade holder 5 and the blade rotating device 7 are aligned relative to the end of the support roll 2 so that the rotational center 8 of the blade holder 5 is concentric with the center axis of the support roll 2. The blade holder 5 extends radially in the direction of the radius of the support roll 2 approximately to the surface of the support roll 2, where a web cutting blade 6 is attached to the end of the blade holder 5.

The cutting blade 6 is a thin, sideways curved blade. The sideways curvature of the blade 6 is made equal to the curvature of the circumference of the support roll 2, and the blade 6 is placed as close as possible to the surface of the support roll 2. Advantageously, the gap between the support roll 2 and the cutting blade 6 is so narrow that only the web being wound can pass through the gap. Further advantageously, the blade should conform to the radius of curvature of the support roll as closely as possible. This is because of the requirement that the blade entering the nip between the winding roll 1 and the support roll 2 may not damage the roll 1. In fact, a thin and properly shaped blade 6 can enter the nip without any complication or any damaging contact to the roll. Advantageously, the blade 6 has the shape of a segment of a circle having a curvature slightly larger than the surface of the support roll, whereby the shape of the blade in practice is equivalent to a portion sectioned from the envelope of virtual cylinder tightly enclosing the support roll.

To permit making the blade 6 sufficiently thin and yet stiff, the blade is tensioned tightly between the blade holders 5. As the blade 6 is also curved and relatively wide, it also is extremely stiff in the direction of the cutting edge 9 of the blade 6. Moreover, the blade 6 must be stiff perpendicularly to the blade side, that is, in the direction of the radius of the support roll 2 and the roll 1, because the blade 6 should not deform when the weight of the roll 1 is imposed onto the blade 6. As a thin blade cannot be made sufficiently stiff by other means, the blade must be tensioned with a high force between the blade holders 5. The cutting edge of the blade may be toothed, as shown in FIG. 2.

Figure 3:
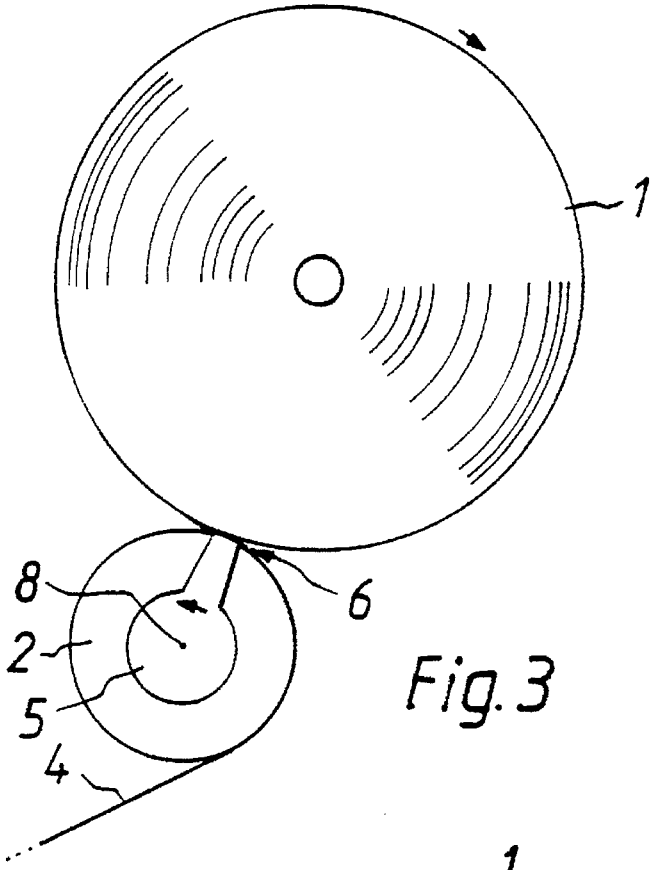
FIGS. 3–5 are diagrammatic side view illustrations of another embodiment of the assembly according to the invention in the different steps of the web cutting action.
Figure 4:
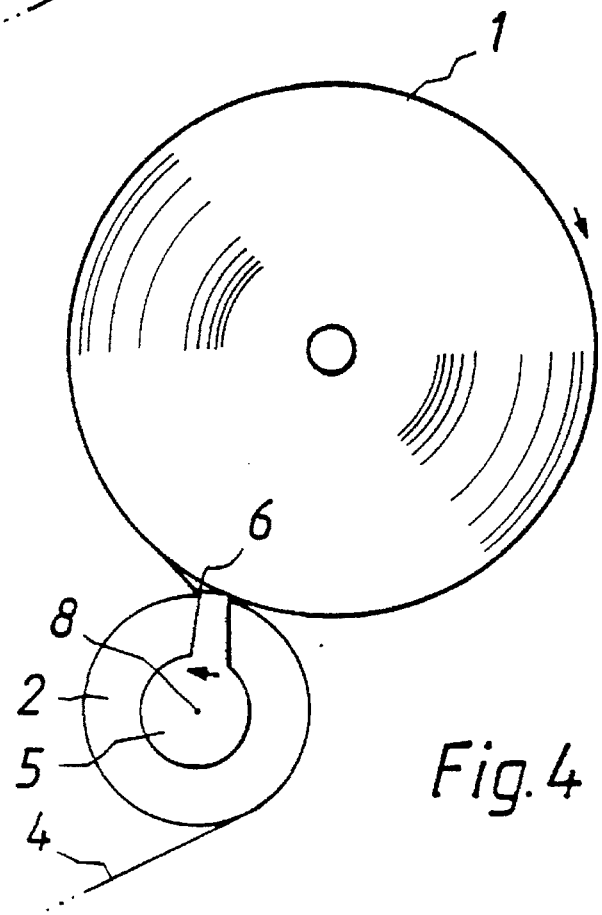
Figure 5:
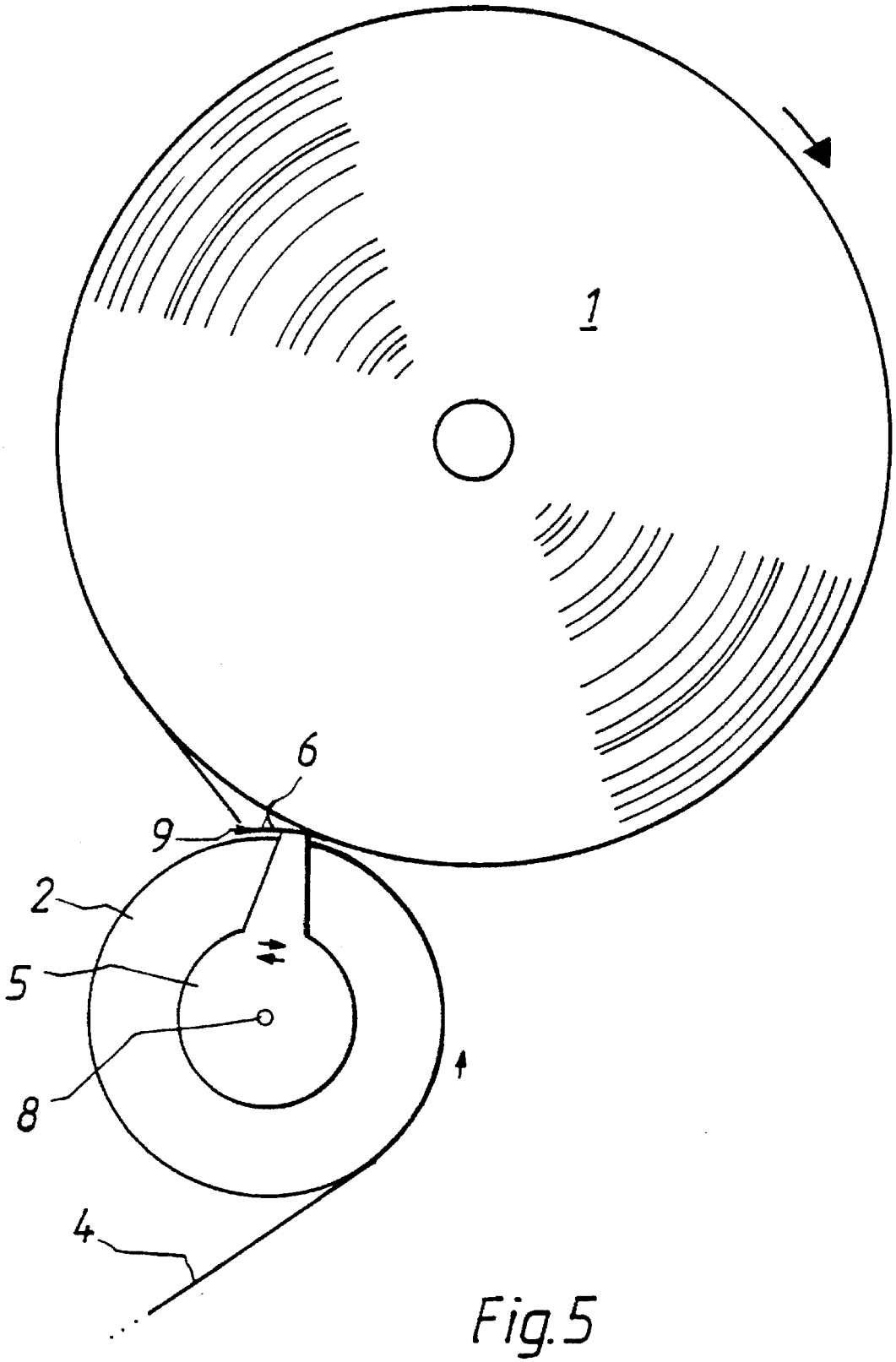

The cutting action according to the present invention is readily explained with the examples illustrated in FIGS. 3–5. In these diagrams is shown a winder employing a single support roll in which the cutting blade 6 is adapted in conjunction with the only support roll 2. In such a winder the web 4 is passed onto the support roll 2 from below the roll and is next turned over the support roll 2 to pass into the nip between the support roll 2 and the winding roll 1. The roll 1 being wound is supported on the support roll 2 with the help of roll change equipment (not shown) which also used to remove the full roll and to position the core of the new roll onto the support roll.

When the control system of the winder determines that the diameter of the roll 1 grown sufficiently large, the web cutting assembly 5, 6, 7 is given a command to cut the web 4. Then, the rotary actuators 7 rotate the cutting blade 6 into the nip between the roll 1 and the support roll 2, whereupon, when caught by the nip, the blade 6 is taken between the support roll 2 and the roll 1 due to their rotational movements. Hence, no major force is required for the rotation of the blade 6. After entering the nip, the cutting blade 6 forces the web 4 being wound onto the roll 1 off the surface of the roll 1 and cuts the web rapidly after the nip. After the web is cut, the full roll is elevated off the support roll 2, and the rotational movement of the support roll 2 is braked to a full stop. The end 9 of the web 4 is held adhering to the surface of the support roll by means of, e.g., a vacuum applied to the inside of the support roll, and additionally, the blade riding on the web 4 assures adherence of the web 4 to the support roll 2. Immediately after the full roll 1 is removed from above the support roll 2, the cutting blade 6 is returned to its home position, a new core is brought onto the support roll 2, the web end 9 is adhered to the core, and the support roll 2 is accelerated to the winding speed. The ends of the web can be attached to the roll 1 and to the new core, respectively, by means of glueing, for instance. The amplitude of the cutting blade swing must be at least large enough to bring the blade past the nip. A wider-amplitude movement is not preferable, and in the most advantageous case, the trailing edge of the blade remains on the ingoing side of the blade into the nip.

Referring again to the embodiment of the present invention illustrated in FIGS. 1 and 2, the roll 1 is rotated freely on the support rolls 2,3 without auxiliary support by any support devices, and the new core 10 is brought into the gap between the support rolls. The cutting action takes place in a similar fashion as in the equipment provided with a single support roll.

While the rotary actuator of the cutting blade is advantageously implemented in the above-described fashion, it is also feasible to replace the rotary actuator operating with the center axis of the support roll as its center of rotation by, e.g., a transfer device driven along a controlled trajectory that moves the cutting blade tangentially close to the roll surface. The actuator of the blade can be driven by an electric motor, hydraulic or pneumatic rotary actuator, cylinder or bellows. The blade can be made from, e.g., steel, or alternatively, from a variety of different composite materials and plastics, as well. Then, the cutting edge of the blade can be made as required from a harder material, whereby longer life against wear is achieved. The cutting edge of the blade may be straight or toothed.

Thus, while there have been shown and described and pointed out fundamental novel features of the invention as applied to a preferred embodiment thereof, it will be understood that various omissions and substitutions and changes in the form and details of the devices illustrated, and in their operation, may be made by those skilled in the art without departing from the spirit of the invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

We claim:

1. A method for cutting a paper or paperboard web in a winder comprising a winding roll about which the web is wound and a support roll, the winding roll being rotatably supported on the support roll, the web being transferred from the support roll to the winding roll in a nip, said method comprising:

cutting the web being wound onto the winding roll by moving at least a leading edge of a cutting blade into the nip formed between the support roll and the winding roll supported on the support roll so that at least the leading edge of the cutting blade travels through the nip to cut the web, the cutting blade being rotatably mounted about the support roll and proximate an outer circumference of the support roll, the blade extending across a width of the web.

2. The method of claim 1, wherein movement of the cutting blade into the nip formed between the support roll and the winding roll is ceased before the entire cutting blade passes through the nip.

3. The method of claim 1, wherein the cutting blade is tensioned along the width of the web.

4. The method of claim 1, wherein the cutting blade is capable of rotating about the support roll in a path substantially parallel to the outer circumference of the support roll.

5. An apparatus for cutting a paper or paperboard web in a winder comprising a winding roll about which the web is wound and a support roll, the winding roll being rotatably supported on the support roll, the web being transferred from the support roll to the winding roll in a nip, said apparatus comprising:

a cutting blade having a width sufficient to extend across a width of the web; and a blade mounting means for grasping said cutting blade and for movably positioning said cutting blade proximate an outer circumference of the support roll so that said cutting blade is rotatable about a portion of the support roll outer circumference and so that at least a leading edge of the blade is capable of travelling through the nip formed between the support roll and the winding roll to cut the web at the nip.

6. The apparatus of claim 5, wherein said blade mounting means comprises two blade holders positioned on opposed edges of the web, said blade holders grasping opposed ends of said cutting blade.

7. The apparatus of claim 6, wherein said blade holders grasp said cutting blade so as to tension said cutting blade between said blade holders.

8. The apparatus of claim 7, wherein said cutting blade has a length such that said cutting blade is at least able to extend entirely through the nip formed between the support roll and the winding roll during cutting of the web.

9. The apparatus of claim 8, wherein said cutting blade is curved so as to be substantially parallel to the portion of the support roll outer circumference.

10. The apparatus of claim 9, wherein an axis of rotation of said blade mounting means is concentric with an axis of rotation of the support roll.

11. The apparatus of claim 10, wherein said blade mounting means comprises an actuator means for selectively causing said cutting blade to rotate about the portion of the support roll outer circumference.

12. The apparatus of claim 6, wherein an axis of rotation of said blade mounting means is concentric with an axis of rotation of the support roll.

13. The apparatus of claim 12, wherein an axis of rotation of said blade holders is concentric with the axis of rotation of the support roll.

14. The apparatus of claim 13, wherein said blade mounting means comprises an actuator means for selectively causing said cutting blade to rotate about the portion of the support roll outer circumference.

15. The apparatus of claim 12, wherein said blade mounting means comprises an actuator means for selectively causing said cutting blade to rotate about the portion of the support roll outer circumference.

16. The apparatus of claim 5, wherein said cutting blade has a length such that said cutting blade is at least able to extend entirely through the nip formed between the support roll and the winding roll during cutting of the web.

17. The apparatus of claim 5, wherein said cutting blade is curved so as to be substantially parallel to the portion of the support roll outer circumference.

18. The apparatus of claim 5, wherein an axis of rotation of said blade mounting means is concentric with an axis of rotation of the support roll.

19. The apparatus of claim 5, wherein said blade mounting means comprises an actuator means for selectively causing said cutting blade to rotate about the portion of the support roll outer circumference.

20. A method for cutting a paper or paperboard web in a winder comprising a winding roll about which the web is wound and a support roll, the winding roll being rotatably supported on the support roll, the web being transferred from the support roll to the winding roll in a nip, said method comprising:

cutting the web being wound onto the winding roll by moving at least a leading edge of a cutting blade into the nip formed between the support roll and the winding roll, the cutting blade being rotatably mounted about the support roll and proximate an outer circumference of the support roll, the blade extending across a width of the web and being tensioned along the width of the web.

21. The method of claim 20, wherein movement of the cutting blade into the nip formed between the support roll and the winding roll is ceased before the entire cutting blade passes through the nip.

22. The method of claim 20, wherein the cutting blade is capable of rotating about the support roll in a path substantially parallel to the outer circumference of the support roll.

23. A method for cutting a paper or paperboard web in a winder comprising a winding roll about which the web is wound and a support roll, the winding roll being rotatably supported on the support roll, the web being transferred from the support roll to the winding roll in a nip, said method comprising:

cutting the web being wound onto the winding roll by moving at least a leading edge of a cutting blade into the nip formed between the support roll and the winding roll, the cutting blade being rotatably mounted about the support roll and proximate an outer circumference of the support roll, the blade extending across a width of the web and being capable of rotating about the support roll in a path substantially parallel to the outer circumference of the support roll.

24. The method of claim 23, wherein movement of the cutting blade into the nip formed between the support roll and the winding roll is ceased before the entire cutting blade passes through the nip.

25. An apparatus for cutting a paper or paperboard web in a winder comprising a winding roll about which the web is wound and a support roll, the winding roll being rotatably supported on the support roll, the web being transferred from the support roll to the winding roll in a nip, said apparatus comprising:

a cutting blade having a width sufficient to extend across a width of the web; and a blade mounting means for grasping said cutting blade and for movably positioning said cutting blade proximate an outer circumference of the support roll so that said cutting blade is rotatable about a portion of the support roll outer circumference through the nip formed between the support roll and the winding roll to cut the web at the nip, said blade mounting means grasping said cutting blade so as to tension said cutting blade in a direction across the width of the web.

26. The apparatus of claims 25, wherein said blade mounting means comprises two blade holders positioned on opposed edges of the web, said blade holders grasping opposed ends of said cutting blade.

27. The apparatus of claim 26, wherein an axis of rotation of said blade mounting means is concentric with an axis of rotation of the support roll.

28. The apparatus of claim 27, wherein an axis of rotation of said blade holders is concentric with the axis of rotation of the support roll.

29. The apparatus of claim 28, wherein said blade mounting means comprises an actuator means for selectively causing said cutting blade to rotate about the portion of the support roll outer circumference.

30. The apparatus of claim 27, wherein said blade mounting means comprises an actuator means for selectively causing said cutting blade to rotate about the portion of the support roll outer circumference.

31. The apparatus of claim 25, wherein said cutting blade has a length such that said cutting blade is at least able to extend entirely through the nip formed between the support roll and the winding roll during cutting of the web.

32. The apparatus of claim 31, wherein said cutting blade is curved so as to be substantially parallel to the portion of the support roll outer circumference.

33. The apparatus of claim 25, wherein said cutting blade is curved so as to be substantially parallel to the portion of the support roll outer circumference.

34. The apparatus of claim 33, wherein an axis of rotation of said blade mounting means is concentric with an axis of rotation of the support roll.

35. The apparatus of claim 34, wherein said blade mounting means comprises an actuator means for selectively causing said cutting blade to rotate about the portion of the support roll outer circumference.

36. The apparatus of claim 25, wherein an axis of rotation of said blade mounting means is concentric with an axis of rotation of the support roll.

37. The apparatus of claim 25, wherein said blade mounting means comprises an actuator means for selectively causing said cutting blade to rotate about the portion of the support roll outer circumference.

38. An apparatus for cutting a paper or paperboard web in a winder comprising a winding roll about which the web is wound and a support roll, the winding roll being rotatably supported on the support roll, the web being transferred from the support roll to the winding roll in a nip, said apparatus comprising:

a cutting blade having a width sufficient to extend across a width of the web; and a blade mounting means for grasping said cutting blade and for movably positioning said cutting blade proximate an outer circumference of the support roll so that said cutting blade is rotatable about a portion of the support roll outer circumference through the nip formed between the support roll and the winding roll to cut the web at the nip, said cutting blade having a length such that said cutting blade is at least able to extend entirely through the nip formed between the support roll and the winding roll during cutting of the web.

39. The apparatus of claim 38, wherein said blade mounting means comprises two blade holders positioned on opposed edges of the web, said blade holders grasping opposed ends of said cutting blade.

40. The apparatus of claim 39, wherein an axis of rotation of said blade mounting means is concentric with an axis of rotation of the support roll.

41. The apparatus of claim 40, wherein an axis of rotation of said blade holders is concentric with the axis of rotation of the support roll.

42. The apparatus of claim 41, wherein said blade mounting means comprises an actuator means for selectively causing said cutting blade to rotate about the portion of the support roll outer circumference.

43. The apparatus of claim 40, wherein said blade mounting means comprises an actuator means for selectively causing said cutting blade to rotate about the portion of the support roll outer circumference.

44. The apparatus of claim 38, wherein said cutting blade is curved so as to be substantially parallel to the portion of the support roll outer circumference.

45. The apparatus of claim 44, wherein an axis of rotation of said blade mounting means is concentric with an axis of rotation of the support roll.

46. The apparatus of claim 45, wherein said blade mounting means comprises an actuator means for selectively causing said cutting blade to rotate about the portion of the support roll outer circumference.

47. The apparatus of claim 38, wherein an axis of rotation of said blade mounting means is concentric with an axis of rotation of the support roll.

48. The apparatus of claim 38, wherein said blade mounting means comprises an actuator means for selectively causing said cutting blade to rotate about the portion of the support roll outer circumference.

49. An apparatus for cutting a paper or paperboard web in a winder comprising a winding roll about which the web is wound and a support roll, the winding roll being rotatably supported on the support roll, the web being transferred from the support roll to the winding roll in a nip, said apparatus comprising:

a cutting blade having a width sufficient to extend across a width of the web; and a blade mounting means for grasping said cutting blade and for movably positioning said cutting blade proximate an outer circumference of the support roll so that said cutting blade is rotatable about a portion of the support roll outer circumference through the nip formed between the support roll and the winding roll to cut the web at the nip, an axis of rotation of said blade mounting means being concentric with an axis of rotation of the support roll.

50. The apparatus of claim 49, wherein said blade mounting means comprises two blade holders positioned on opposed edges of the web, said blade holders grasping opposed ends of said cutting blade.

51. The apparatus of claim 49, wherein said cutting blade is curved so as to be substantially parallel to the portion of the support roll outer circumference.

52. The apparatus of claim 49, wherein said blade mounting means comprises an actuator means for selectively causing said cutting blade to rotate about the portion of the support roll outer circumference.

* * * * *